US010482859B1

(12) United States Patent
Horban et al.

(10) Patent No.: US 10,482,859 B1
(45) Date of Patent: Nov. 19, 2019

(54) OPTICAL SENSOR AND ELECTRIC STRINGED MUSICAL INSTRUMENT WITH DIGITAL INTERFACE (MIDI) EQUIPPED WITH OPTICAL SENSOR

(71) Applicant: JAMMY INSTRUMENTS LTD, Nicosia (CY)

(72) Inventors: Mykhailo Horban, Kharkov (UA); Dmytro Doroshenko, Kyiv (UA); Serhii Nastiuk, Kyiv (UA); Leonid Novichkov, Sievierodonetsk (UA); Volodymyr Shelest, Kyiv (UA)

(73) Assignee: JAMMY INSTRUMENTS LTD., Nicosia (CY)

( * ) Notice: Subject to any disclaimer, the term of this patent is extended or adjusted under 35 U.S.C. 154(b) by 0 days.

(21) Appl. No.: 16/180,372

(22) Filed: Nov. 5, 2018

(30) Foreign Application Priority Data

Sep. 13, 2018 (UA) ..... A201809324

(51) Int. Cl.

| | |
|---|---|
| ***G10H 1/34*** | (2006.01) |
| ***G10H 1/04*** | (2006.01) |
| ***G10D 3/10*** | (2006.01) |
| ***G10H 7/00*** | (2006.01) |
| ***G10H 1/00*** | (2006.01) |

(52) U.S. Cl.
CPC ..... *G10H 1/342* (2013.01); *G10D 3/10* (2013.01); *G10H 1/0066* (2013.01); *G10H 7/008* (2013.01)

(58) Field of Classification Search
CPC ..... G06F 3/042; G06F 2203/04106; G10H 1/342; G10H 2220/525; G10H 1/0553; G10H 3/06; G10H 2220/061; G10H 2220/421; G10H 2240/255; G02B 6/0001; G02B 6/001; G02B 6/4292; F21S 43/14; G02F 1/13338; G02F 2001/133394
See application file for complete search history.

(56) References Cited

U.S. PATENT DOCUMENTS

| | | | |
|---|---|---|---|
| 4,630,520 | A | 12/1986 | Bonanno |
| 4,688,460 | A | 8/1987 | McCoy |
| 4,730,530 | A | 3/1988 | Bonanno |
| 5,214,232 | A | 5/1993 | Iijima et al. |
| 5,237,126 | A | 8/1993 | Curtis et al. |

(Continued)

FOREIGN PATENT DOCUMENTS

| | | |
|---|---|---|
| FR | 2 845 194 A1 | 4/2004 |
| UA | 23109 U | 5/2007 |

*Primary Examiner* — Marlon T Fletcher
(74) *Attorney, Agent, or Firm* — Saliwanchik, Lloyd & Eisenschenk

(57) ABSTRACT

The inventions relate to the field of electric musical instruments, more particularly, to an optical sensor for a stringed musical instrument with a digital interface and to a stringed musical instrument with a digital interface equipped with said sensor (MIDI—Musical Instrument Digital Interface). Implementation of the disclosed inventions allows to obtain a signal corresponding to vibrations (deflections) of a string in two mutually perpendicular planes, with the influence of the device generating such signals on string vibration parameters being reduced, without signals generated by different strings being mixed and with dimensions of the optical sensor being reduced to allow for its compact placement on a stringed musical instrument.

20 Claims, 5 Drawing Sheets

(56) References Cited

U.S. PATENT DOCUMENTS

| | | | | |
|---|---|---|---|---|
| 5,909,028 | A * | 6/1999 | Yamamoto | G01D 5/34 250/221 |
| 6,297,437 | B1 * | 10/2001 | Ura | G10H 1/0553 84/18 |
| 7,129,468 | B2 | 10/2006 | Ennes | |
| 8,071,870 | B1 | 12/2011 | Bailey et al. | |
| 2002/0062728 | A1 * | 5/2002 | Muramatsu | G10G 3/04 84/724 |
| 2003/0094567 | A1 * | 5/2003 | Ennes | G01H 9/00 250/222.1 |
| 2003/0202753 | A1 * | 10/2003 | Kato | G02B 6/4204 385/88 |
| 2009/0151548 | A1 * | 6/2009 | Kikumoto | G01D 5/342 84/640 |
| 2010/0083807 | A1 * | 4/2010 | Sullivan | G10H 1/342 84/315 |
| 2010/0083808 | A1 * | 4/2010 | Sullivan | G10H 1/342 84/315 |
| 2011/0061517 | A1 * | 3/2011 | Haddad | G10H 3/06 84/724 |
| 2011/0132180 | A1 * | 6/2011 | Gobbers | G10H 1/14 84/622 |
| 2012/0266740 | A1 | 10/2012 | Hilbish et al. | |
| 2013/0138233 | A1 * | 5/2013 | Sandler | G06F 17/00 700/94 |
| 2014/0260922 | A1 * | 9/2014 | Jennings | G10H 3/143 84/731 |
| 2015/0317967 | A1 | 11/2015 | Haddad | |

* cited by examiner

OPTICAL SENSOR AND ELECTRIC STRINGED MUSICAL INSTRUMENT WITH DIGITAL INTERFACE (MIDI) EQUIPPED WITH OPTICAL SENSOR

CROSS-REFERENCE TO RELATED APPLICATION

This application claims the benefit under 35 U.S.C. § 119 of Ukrainian Application No. a201809324, filed Sep. 13, 2018, which is hereby incorporated by reference in its entirety.

FIELD OF THE INVENTION

The inventions relate to the field of electric musical instruments, more particularly, to an optical sensor for a stringed musical instrument with a digital interface and to a stringed musical instrument with a digital interface equipped with said sensor (MIDI—Musical Instrument Digital Interface).

BACKGROUND OF THE INVENTION

Today, several main types of sensors or pickups are used for electric stringed musical instruments which allow to receive and process an electric signal corresponding to a string vibration, such as electromagnetic, piezoelectric and optical sensors.

Said types of sensors are well-suited for traditional electric guitars and allow to reproduce acoustic sounds of a string quite naturally.

However, when it comes to MIDI instruments, the solutions known in the art have a number of significant drawbacks or limitations.

As one of essential requirements for MIDI instruments according to the signal processing algorithm, it is important to form a separate signal from each individual string. In this case, there should be no, or at least minimized, mutual influences of vibrations of other strings on a signal produced by a particular string, regardless of the nature of such influences. The influence of the sensor itself on string vibrations is also undesirable.

Standard electromagnetic and piezoelectric sensors cannot provide a high-quality separation of signals produced by individual strings due to the presence of electromagnetic or mechanical effects of vibrations of one string on the formation of signals by other strings. When polyphonic sensors having a separate sensor (an electromagnetic coil or a piezoelectric sensor) are used for each string, the influence of one string on the signal formation by other strings is reduced substantially; however complete interference is still not achieved.

Further, to minimize delays in sound generation based on processed string vibration signal, the sensor should provide, as far as possible, dynamic information on a change of a signal (vibrations) as well as static data on deflections of a string from its initial ("zero") position at different points of time. This data allows to determine the mechanical parameters of the system before and at the moment of influence on a string ("pinch", "hit", touch to a string) more accurately and, respectively, to form the basic characteristics of the corresponding generated acoustic signal with a lower delay and as accurately as possible: height, volume, level of attack, and duration of sound.

Further, for MIDI instruments, in terms of a comprehensive analysis of the mechanical influence exerted on a string by a musician, it is useful to have information in at least two planes—horizontal and vertical. This allows to distinguish between different types of influence ("pinch", "hit", touch to a string) and, accordingly, to adjust parameters of the acoustic signal so generated. This information is also very useful to analyze the influence on a string on a neck of a stringed instrument (shifting a string, pressing a string), which, along with the signals from other sensors of a MIDI controller, allows to more fully use playing techniques used when playing on a standard acoustic or electric guitar (bending, tremolo, "hammer-on", "pull off" and others). Electromagnetic and piezoelectric sensors, in their standard embodiments, cannot provide said data given physical constraints and principles of operation.

Optical sensors (a signal pickup is achieved using the effect of a light beam reflected from a vibrating string on a light-sensitive element) can provide a high-quality separation of a signal produced by individual strings and avoid the influence of a sensor on a string. However, such sensors, known in the art, are of fairly large size and require the placement of optical emitters and receivers directly above, under, or along the sides of a string. Such placement makes an instrument bulky and inconvenient to use.

The prior art discloses a large number of technical solutions related to optical sensors and stringed musical instruments equipped with said sensors, including: FR2845194A1 dd. Apr. 2, 2004; UA23109 dd. May 10, 2007; U.S. Pat. No. 4,630,520 dd. Dec. 23, 1986; U.S. Pat. No. 4,730,530 dd. Mar. 15, 1988; U.S. Pat. No. 5,237,126 dd. Aug. 17, 1993; U.S. Pat. No. 7,129,468 dd. Dec. 31, 2006; U.S. Pat. No. 8,071,870 dd. Dec. 6, 2011; US2012266740 dd. Oct. 25, 2012; US2015317967 dd. Nov. 5, 2015 and others.

The prior art discloses an optical pickup for a stringed instrument for producing information as to the frequency of vibration of a string thereof, comprising: optical emitter means for producing a light beam of 1-5 mm aperture, located so that said string passes in and out of said light beam when said string is vibrating; and optical detector means for detecting said optical field produced by said optical emitter means after being modulated by the motion of said string and converting said detecting optical field into an signal, said emitter means and detector means being arranged such that the plane of said optical emitter means and said optical detector means is substantially parallel to the plane of the strings of said instrument (U.S. Pat. No. 4,688,460 dd. Aug. 25, 1987).

A technical solution disclosed in U.S. Pat. No. 5,214,232 dd. May 25, 1993, was taken as a prototype, specifically: an electric stringed musical instrument comprising a body, at least one string stretched over said body, a detecting unit fixed to said body, and located below said at least one string, said detecting unit having at least one photo emitting element for radiating light toward said at least one string, and a photo detecting element for receiving reflection of said light from said at least one string and producing photo current indicative of the intensity of said reflection, said intensity of said reflection being varied when said at least one string is vibrated, variation of said reflection being indicative of vibrations of said at least one string in both lateral and vertical directions, and sound producing means supplied with said photo current for producing sounds, said photo detecting element having a detectable range for a minimum intensity of said reflection, said at least one string being located at a midpoint evenly spaced apart from a boundary of said detectable range in directions on a virtual plane substantially parallel thereto when remaining stationary, and said photo detecting element having a focal point beyond said at least one string, said photo current being increased along plots having a linear zone toward said focal point with said at least one string being vibrated within said linear zone.

The disadvantages of said prior art and the prototype are the inability to obtain distinct separate signals that would correspond to deflections (vibrations) of a string in two mutually perpendicular planes. A signal formed as current generated by illumination of the light-receiving element by reflected radiation does not allow to clearly distinguish vibrations in two mutually perpendicular planes and, accordingly, to form such acoustic vibrations with sound-producing means that would correspond to actual vibrations of a string in space.

SUMMARY OF THE INVENTION

One aspect of the invention is to obtain a signal that would correspond, as far as possible, to real vibrations of a string in space, which, in the process of playing, are more complicated by their nature than simple vibrations of a string in one plane, and, consequently, to provide an opportunity to reflect the peculiarities of technical and stylistic techniques of playing a stringed instrument. Another aspect is to generate signals that reflect vibrations of strings arranged close to each other and to reduce the influence of vibrations of one string on a signal generated by vibrations of another string and to reduce the influence of the sensor on a string. Yet another aspect is to create a compact sensor to minimize or eliminate the influence of said sensor on the playing technique and to ensure ease of use of the instrument.

The foregoing is achieved in that an optical sensor for a stringed musical instrument with a digital interface comprises:

a housing configured to be fixed to the surface of the stringed musical instrument, at least one optical emitter and at least one optical receiver located on said housing so that a light beam of at least one optical emitter forms a light spot that completely covers a photosensitive surface of at least one optical receiver, with at least one optical emitter and at least one optical receiver being located under the same string, wherein, according to the invention, said optical emitter generates light beams, said optical receiver comprises at least two photosensitive surfaces, forming, together with said optical emitter, at least two optical pairs, a lower one and an upper one respectively, a light beam modulator located between said optical pairs, covering a part of each of the photosensitive surfaces, and configured to be fixed to a string and configured to adjust an area of an illuminated part of the upper photosensitive surface and an area of an illuminated part of the lower photosensitive surface when a string, with said modulator attached thereto, deflects in horizontal and vertical planes, respectively.

An optical sensor can be equipped with a string vibration damper having the form of an elastic element.

Light beams coming from said optical emitter to said optical receiver are parallel to each other and to a string.

Said optical emitter can be configured as two LEDs.

An optical sensor can comprise additional optical emitters.

Said optical receiver can be configured as a photodiode or as a phototransistor, or as a photoresistor, or as a photomatrix.

Said modulator is configured as an opaque element.

Said modulator can overlap at least half of each of the photosensitive surfaces in a state when a string does not vibrate.

Said light beam modulator can be configured to be L- or T-shaped.

The lower part of said light beam modulator can be configured to have an additional elastic element to fix the modulator to the surface of a stringed musical instrument, such as a spring.

The invention is also achieved in embodiments where a stringed musical instrument with a digital interface comprises:

a body, at least one string stretched over said body, an optical sensor comprising a housing attached to the surface of the body of the stringed musical instrument, at least one optical emitter and at least one optical receiver located on said housing so that a light beam of at least one optical emitter forms a light spot that completely covers a photosensitive surface of at least one optical receiver, with at least one optical emitter and at least one optical receiver being located under the same string, wherein, according to the invention, said optical emitter generates light beams, said optical receiver comprises at least two photosensitive surfaces, forming, together with said optical emitter, at least two optical pairs, a lower one and an upper one respectively, a light beam modulator located between said optical pairs, covering a part of each of the photosensitive surfaces, and configured to be fixed to a string and configured to adjust an area of an illuminated part of the upper photosensitive surface and an area of an illuminated part of the lower photosensitive surface when a string, with said modulator attached thereto, deflects in horizontal and vertical planes, respectively.

Said optical sensor can be equipped with a string vibration damper having the form of an elastic element.

Light beams coming from said optical emitter to said optical receiver are parallel to each other and to a string.

Said optical emitter can be configured as two LEDs.

Said optical sensor can comprise additional optical emitters.

Said optical receiver can be configured as a photodiode or as a phototransistor, or as a photoresistor, or as a photomatrix.

Said modulator is configured as an opaque element.

Said modulator can overlap at least half of each of the photosensitive surfaces in a state when a string does not vibrate.

Said light beam modulator can be configured to be L- or T-shaped.

A lower part of said light beam modulator can be configured to have an additional elastic element to fix the light beam modulator to the surface of a stringed musical instrument, such as a spring.

There is a causal relationship between elements of embodiments of the invention and the technical result achieved with their use as described below.

As stated above, the prior art discloses an electric stringed musical instrument equipped with an optical sensor with at least one optical emitter and at least one optical receiver. However, said optical sensor does not allow to achieve the maximum accurate pickup of a signal of string vibrations in a three-dimensional space. The inventor of the subject invention made a significant number of experiments to improve the reception of a signal corresponding to vibrations (deflections) of a string in two mutually perpendicular planes with no influence of the device generating such signals on parameters of string vibrations and with no influence of one string on signal generation by another string. The process of testing the optical sensor demonstrated that the optical emitter configured to form light beams and the optical receiver comprising at least two photosensitive surfaces, where light beams illuminate the photosensitive surfaces, allows to achieve the maximum level of a signal. Such embodiment of the optical emitter and the optical receiver forms at least two optical pairs, the lower one and the upper one respectively, where light beams coming from the optical emitter to the optical receiver are parallel to each other and to a string allowing to differentiate a signal both in the horizontal plane (horizontal deflection of a string) and in the vertical plane (vertical deflection of a string). Further, such embodiment of the optical sensor significantly reduces its size and allows it to be compactly and easily installed on the body of a stringed musical instrument.

According to yet other embodiments of the invention, the optical sensor can comprise additional optical emitters. Additional optical emitters allow to achieve more even illumination of the photosensitive surfaces of the optical receiver.

According to still other embodiments of the invention, the optical emitter is configured as two LEDs, and the optical receiver is configured as a photodiode or as a phototransistor, or as a photoresistor, or as a photomatrix. Such embodiments of optical sensor elements allow to simplify the design of the optical sensor using the simplicity of the embodiments of said elements. Further, such embodiments of optical sensor elements allow for easy access to said elements and, if necessary, easy replacement thereof, since these elements are quite widely used today. To increase the dynamic sensitivity range of the optical sensor, the optical receiver can be configured to have an enlarged area of the photosensitive surface and/or configured to have lenses.

Other optical circuits known in the art can be used as a certain set of light sources and means for forming light spots of a given size, which will provide illumination of the two photosensitive surfaces.

According to yet another embodiment of the invention, a light beam modulator located between the optical pairs, covering the part of each of the photosensitive surfaces, and configured to be fixed to a string and configured to adjust the area of the illuminated part of the upper photosensitive surface and the area of the illuminated part of the lower photosensitive surface when a string (with the modulator attached thereto) deflects in horizontal and vertical planes, respectively. Thus, the embodiment of the modulator in the optical sensor allows to provide a sufficient range of variation in the area of illumination of the two photosensitive surfaces, and the embodiment of the configured to be fixed to a string allows to connect the modulator to a string tightly so that any deflection of a string in a horizontal or vertical direction causes the corresponding motion of the modulator and, in its turn, changes the illumination of the photosensitive surfaces of the optical receiver. Thus, a signal corresponding to vibrations (deflections) of a string in two mutually perpendicular planes is received with the influence of the device generating such signals on parameters of string vibrations being reduced.

According to yet another embodiment of the invention, the modulator overlaps at least half of each of the photosensitive surfaces in a state when a string does not vibrate. Such embodiment of the modulator allows to provide a change in the level of illumination of the photosensitive surfaces in a wide amplitude range of string vibrations practically with a linear dependence of the illumination level of a photosensitive surface on the amplitude of string vibrations in the corresponding plane.

The modulator is configured as an opaque element. Such embodiment of the modulator allows to ensure that light beams do not pass through the body of the modulator.

According to yet another aspect of the invention, the light beam modulator is configured to be L- or T-shaped. Such embodiment of the modulator allows to provide the required interruption of light beams and the corresponding change in the illuminated area of light-sensitive elements when a string, with the modulator attached thereto, deflects in a horizontal and vertical planes simultaneously.

According to still another aspect of the invention, the lower part of the light beam modulator is configured to have an additional elastic element to fix the modulator to the surface of a stringed musical instrument, such as a spring. The embodiment of an additional elastic element to fix the modulator allows to provide a more precise initial orientation of the modulator. The spring provides an elastic fixing of the modulator to the surface of a stringed musical instrument and, at the same time, the modulator can freely deflect in the vertical and horizontal directions as the string moves.

According to one of the embodiments of the invention, the optical sensor is equipped with a string vibration damper having the form of an elastic element. Thus, the amplitude of string vibrations is damped or reduced, if string vibrations are long, when a musician exerts influence on the string. For stringed MIDI instruments, additional string damping is required to more accurately separate string vibrations (deflections) in the "sustain" phase and vibrations generated by a new influence on a string, this allows to simplify signal processing algorithms and to expand the applicability in various styles of playing and sound generation by an electric instrument.

According to other embodiments of the invention disclosed herein, a stringed musical instrument with a digital interface comprises a body, at least one string stretched over said body and an optical sensor. The embodiment of said optical sensor in the design of the stringed musical instrument allows to obtain a signal corresponding to vibrations (deflections) of a string in two mutually perpendicular planes, with reduced influence of the device generating such signals on parameters of string vibrations and with no mixing of signals generated by different strings, and, at the same time, with reduced dimensions of the optical sensor to allow for a compact placement thereof on a stringed musical instrument.

The process of testing the stringed musical instrument with a digital interface and the optical sensor installed thereon demonstrated that the optical emitter configured to form light beams and the optical receiver comprising at least two photosensitive surfaces, where light beams illuminate the photosensitive surfaces, allows to achieve the maximum level of a signal. Such embodiment of the optical emitter and the optical receiver forms at least two optical pairs, the lower one and the upper one respectively, where light beams coming from the optical emitter to the optical receiver are parallel to each other and to a string allowing to differentiate a signal both in the horizontal plane (horizontal deflection of a string) and in the vertical plane (vertical deflection of a string). Further, such embodiment of the optical sensor significantly reduces its size and allows it to be compactly and easily installed on the body of a stringed musical instrument.

According to yet another aspect of the invention, the optical sensor can comprise additional optical emitters. Additional optical emitters allow to achieve more even illumination of the photosensitive surfaces of the optical receiver.

According to yet other embodiments of the invention, the optical emitter is configured as two LEDs, and the optical receiver is configured as a photodiode or as a phototransistor, or as a photoresistor, or as a photomatrix. Such embodiment of optical sensor elements allows to simplify the design of the optical sensor using the simplicity of the embodiment of said elements and, as such, to provide a simple embodiment and fixing of the optical sensor on a stringed musical instrument. Further, such embodiment of optical sensor elements allows for easy access to said elements and, if necessary, easy replacement thereof, since these elements are quite widely used today. To increase the dynamic sensitivity range of the optical sensor, the optical receiver can be configured to have an enlarged area of the photosensitive surface and/or configured to have lenses.

Other optical circuits known in the art can be used as a certain set of light sources and means for forming light spots of a given size, which will provide illumination of the two photosensitive surfaces.

According to yet another aspect of the invention, a light beam modulator located between the optical pairs, covering the part of each of the photosensitive surfaces, and configured to be fixed to a string and configured to change the area of the illuminated part of the upper photosensitive surface and the area of the illuminated part of the lower photosensitive surface when a string (with the modulator attached thereto) deflects in horizontal and vertical planes, respectively. The embodiment of the modulator in the optical sensor in such way allows to provide a sufficient range of variation in the area of illumination of the two photosensitive surfaces, and the embodiment of the configured to be fixed to a string allows to connect the modulator to a string tightly so that any deflection of a string in a horizontal or vertical direction causes the corresponding motion of the modulator and, in its turn, changes the illumination of the photosensitive surfaces of the optical receiver. Thus, a signal corresponding to vibrations (deflections) of a string in two mutually perpendicular planes is received with the influence of the device generating such signals on parameters of string vibrations being reduced.

According to yet another embodiment of the invention, the modulator overlaps at least half of each of the photosensitive surfaces in a state when a string does not vibrate. Such embodiment of the modulator allows to provide a change in the level of illumination of the photosensitive surfaces in a wide amplitude range of string vibrations practically with a linear dependence of the illumination level of a photosensitive surface on the amplitude of string vibrations in the corresponding plane.

The modulator is configured as an opaque element. Such embodiment of the modulator allows to ensure that light beams do not pass through the body of the modulator.

According to yet another embodiment of the invention, the light beam modulator is configured to be L- or T-shaped. Such embodiment of the modulator allows to provide the required interruption of light beams and the corresponding change in the illuminated area of light-sensitive elements when a string, with the modulator attached thereto, deflects in a horizontal and vertical planes simultaneously.

According to yet another embodiment of the invention, the lower part of the light beam modulator is configured to have an additional elastic element to fix the modulator to the surface of a stringed musical instrument, such as a spring. The embodiment of an additional elastic element to fix the modulator allows to provide a more precise initial orientation of the modulator. The spring provides an elastic fixing of the modulator to the surface of a stringed musical instrument and, at the same time, the modulator can freely deflect in the vertical and horizontal directions as the string moves.

According to one of the embodiments of the invention, the optical sensor is equipped with a string vibration damper having the form of an elastic element. Thus, the amplitude of string vibrations is damped or reduced, if string vibrations are long, when a musician exerts influence on the string. For stringed MIDI instruments, additional string damping is required to more accurately separate string vibrations (deflections) in the "sustain" phase and vibrations generated by a new influence on a string, this allows to simplify signal processing algorithms and to expand the applicability in various styles of playing and sound generation by an electric instrument.

BRIEF DESCRIPTION OF THE DRAWINGS

The inventions disclosed herein will be more clearly understood from the following exemplary embodiments in conjunction with the accompanying drawings in which.

Figure 1:
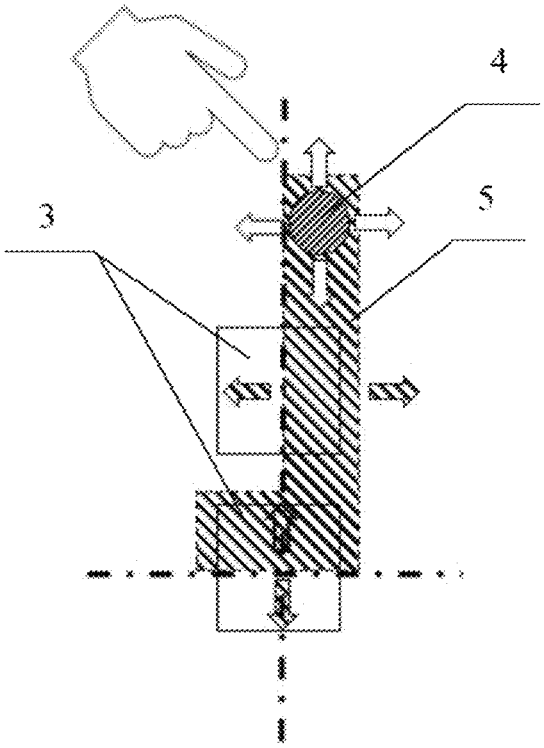
FIG. 1 is a schematic front view of the modulator, optical receivers and a string (along the axis of the string).
Figure 2:
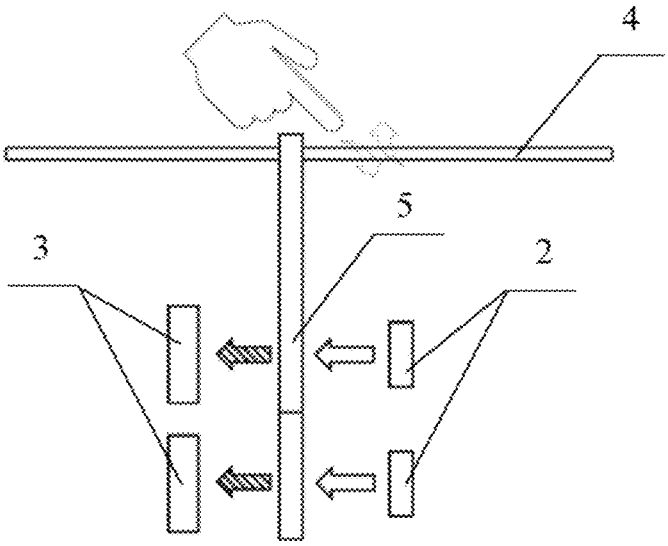
FIG. 2 is a schematic side view of a string, the modulator and optical pairs.
Figure 3:
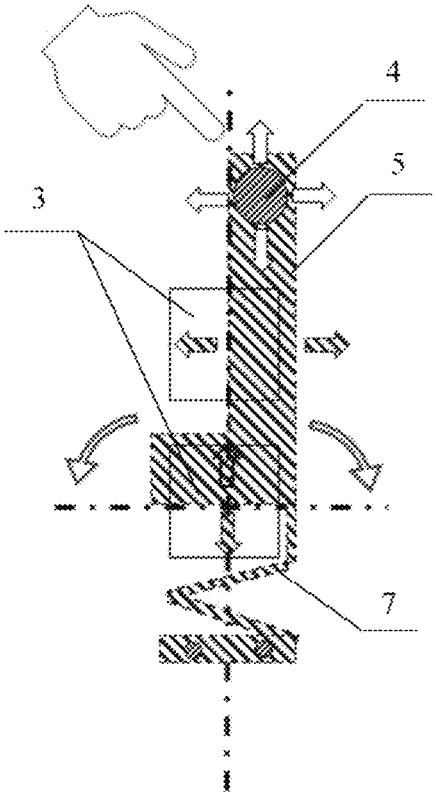
FIG. 3 is a schematic front view of the modulator, optical receivers, a string (along the axis of the string) and an additional elastic element to fix the modulator to the surface of the stringed musical instrument.
Figure 4:
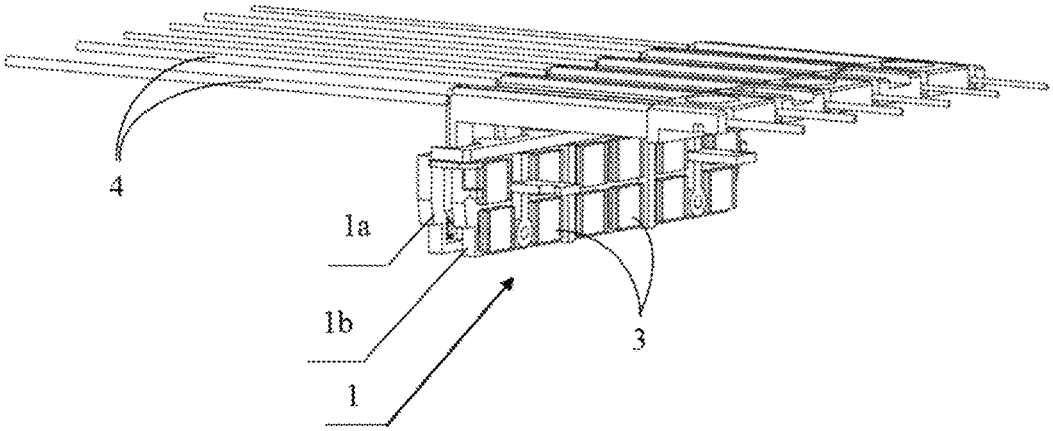
FIG. 4 is a view of optical sensors with strings from the side where the optical receivers are placed.
Figure 5:
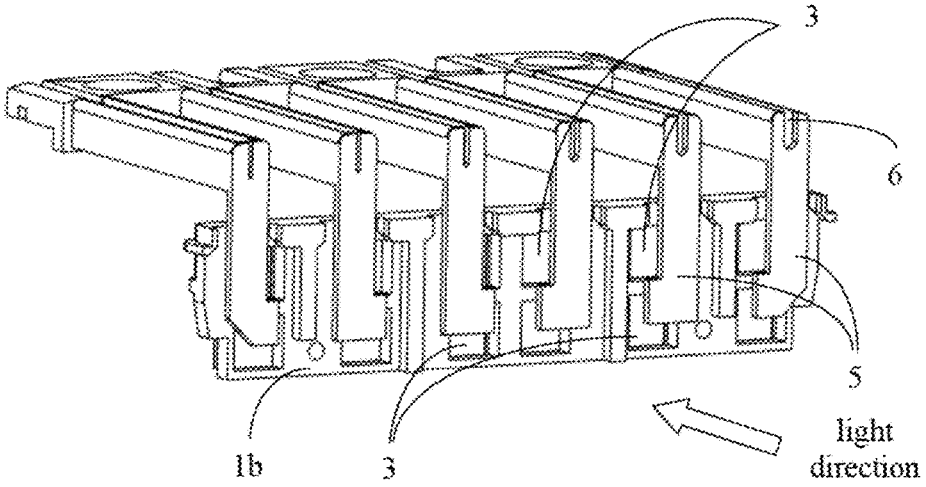
FIG. 5 is a view of optical sensors with modulators.
Figure 6:
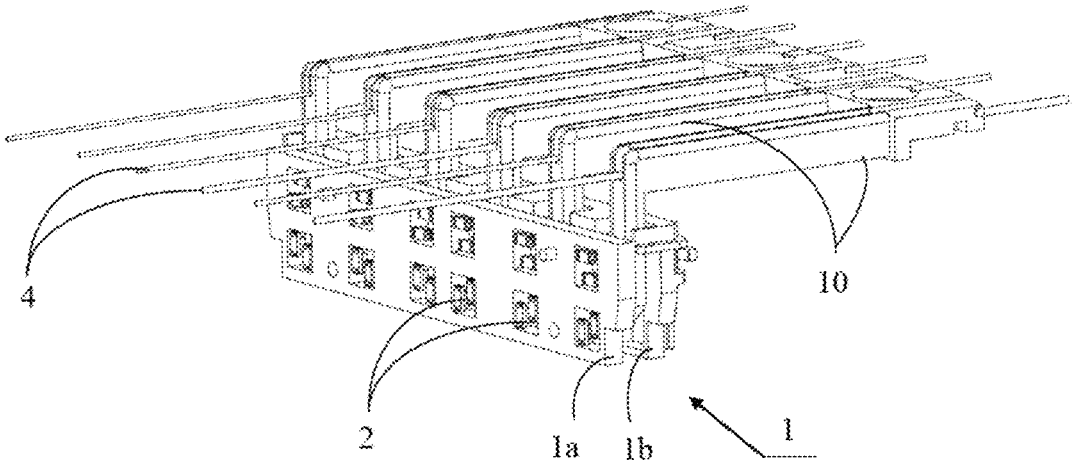
FIG. 6 is a view of optical sensors with strings from the side where the optical emitters are placed.
Figure 7:
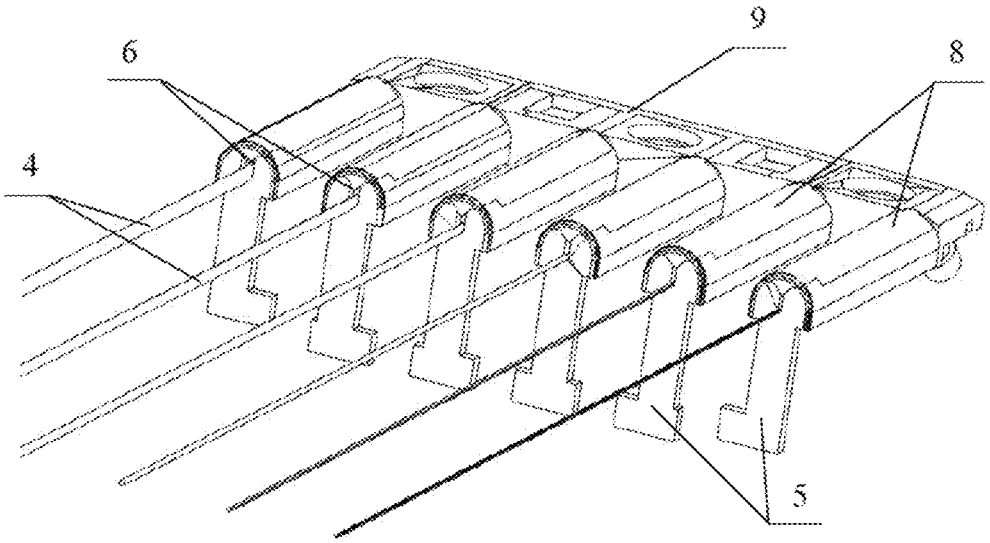
FIG. 7 is a view of string vibration dampers located on the body, with modulators of different shapes (L- or T-shaped) installed on strings.
Figure 8:
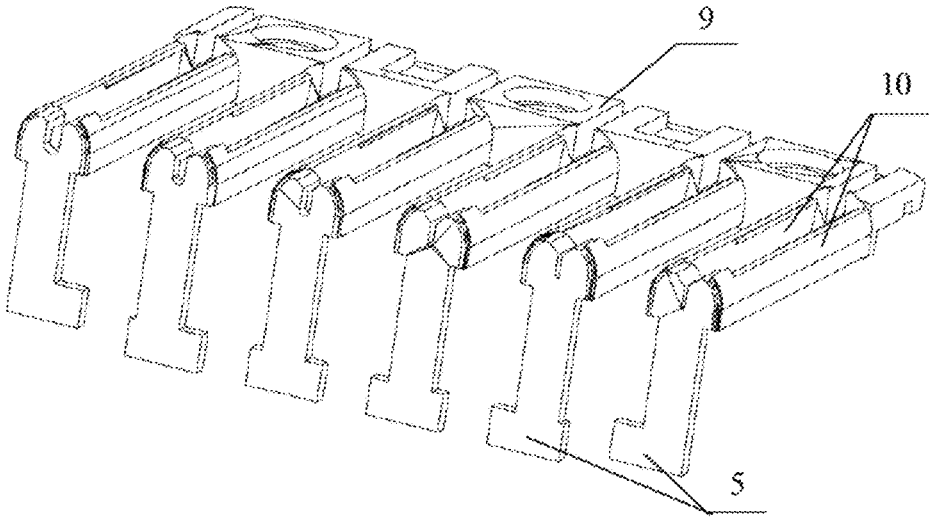
FIG. 8 is a view of the frame with plates without any string vibration dampers installed thereon.
Figure 9:
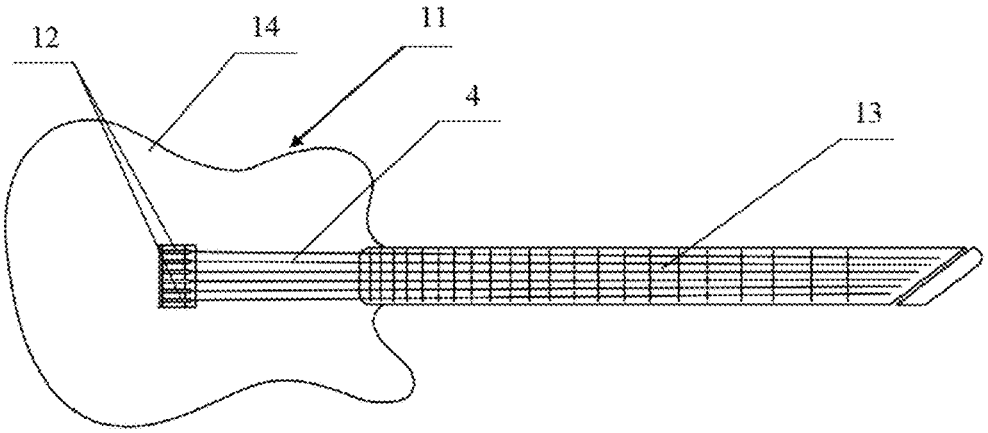
FIG. 9 is a view of the stringed musical instrument, in particular an electric guitar, with optical sensors.

Figurative materials that illustrate the inventions disclosed herein as well as particular embodiments are in no way intended to limit the claims appended hereto but to explain the essence of the inventions.

DETAILED DESCRIPTION OF THE INVENTION (INFORMATION CONFIRMING THE POSSIBILITY OF THE EMBODIMENTS OF THE INVENTION)

An optical sensor for a stringed musical instrument with a digital interface comprises a housing 1, made of two parts 1*a* and 1*b*, which are interconnected.

An optical emitter 2 and an optical receiver 3 having a photosensitive surface are located on the housing 1 on the same axis, in particular an optical emitter 2 is located on the part 1*a* of the housing 1, and the optical receiver 3 is located on the part 1*b* of the housing 1. The optical emitter 2 is configured as two LEDs. The optical receiver 3 can be configured as a photodiode. The optical receiver 3 can also be configured as a phototransistor, or a photoresistor, or a photomatrix. Further, the optical emitter 2 and the optical receiver 3 can be configured in any way known in the art.

The housing 1 is fixed to the surface of a stringed musical instrument with either side by any method known in the art, with the optical emitter 2 and the optical receiver 3 being located under the same string 4. In the proposed embodiment, the housing 1 is fixed to the surface of the stringed musical instrument using one of the types of mechanical fixing known in the art or using an adhesive joint, in particular by means of a screw connection.

As noted above, the optical emitter 2 is configured as two LEDs, which form two light beams, respectively. Further, the optical receiver 3 comprises two photosensitive surfaces located one above the other. Thus, the optical emitter 2 and the optical receiver 3 form two optical pairs, the lower one and the upper one respectively. Further, in another embodiment of the invention, the optical emitter 2 can comprise any number of light sources forming at least two light beams.

With such location of the optical sensor elements, light beams between the optical pairs are directed parallel to each other and to the string 4, with each of the light beams illuminating the corresponding photosensitive surface.

In the proposed embodiment, the optical sensor can comprise additional optical emitters 2.

A light beam modulator 5 installed on the side of the housing 1, opposite to the side of the fixing to the surface of a stringed musical instrument, is located between the optical pairs. The modulator 5 is configured as an opaque element having the form of a plate, either L- or T-shaped. On one of its sides, the modulator 5 is configured to be fixed to the string 6, having the form of a groove wherein the string 4 is tightly inserted, so that the modulator 5 is fixed to the string 4.

In a static state, the modulator 5, fixed to the string 4, overlaps with its shape a part of each of the photosensitive surfaces of the optical receiver 3, in particular a half of each of the photosensitive surfaces.

In another embodiment of the invention, an additional elastic element to fix the modulator 7 to the surface of the stringed musical instrument, such as a spring, is located in the lower part of the light beam modulator 5.

In yet another embodiment, the optical sensor is equipped with a spring vibration damper 8, having the form of an elastic lining. Said damper 8 is inserted in the frame 9, in particular between two plates 10 of the frame 9, which are bent as the string 4 vibrates, and is fixed to it by any method known in the art, for example, by means of a catch. In the proposed embodiment, the frame 9 is fixed to the surface of the stringed musical instrument using a screw connection.

Other embodiments of the present invention include a stringed musical instrument with a digital interface comprising a body, at least one string 4 stretched over the body and an optical sensor as disclosed above.

A stringed musical instrument with a digital interface can be any MIDI instrument known in the art.

In the proposed embodiment, a string musical instrument with a digital interface has the form of an electric guitar.

The electric guitar comprises a body 11, strings 4 stretched over the body 11, and optical sensors 12 fixed to the surface of the body 11. The body 11 comprises a neck 13 and a main body 14.

The number of optical sensors 12 corresponds to that of strings 4. The design of the optical sensor 12 is described above. In the proposed embodiment, the base 1 of the optical sensor 12 is fixed to the body of an electric guitar with one of the known types of mechanical fixing or using adhesive joints, in particular by means of a screw connection.

The optical sensor 12 works as follows. The base 1, on which the optical emitter 2 and the optical receiver 3 are located on the same axis, is installed directly under the string 4 and is fixed to the body of the stringed musical instrument having a digital interface.

While in operation, the optical emitter 2 forms two light beams, parallel to a string, and the optical receiver 3, with two photosensitive surfaces, reads the vibrations (deflections) of the string as a response to a change in light intensity.

The modulator 5 is located on a string between the optical emitter 2 and the optical receiver 3. Any vibration (deflection) of the string 4, horizontally or vertically, causes a corresponding movement of the modulator 5, which changes the area of the illuminated part of the upper photosensitive surface in the horizontal plane and the area of the illuminated part of the lower photosensitive surface in the vertical plane.

Thus, the signal is differentiated in two mutually perpendicular planes.

The electric guitar works as follows. The optical sensor 12 located under the string 4 is fixed to the body 11. The number of optical sensors 12 corresponds to that of the strings 4.

While playing the electric guitar, one exerts influence on the strings 4 causing vibrations thereof and a signal is picked up with the optical sensor 12 operated as described above.

Thus, the application of the disclosed inventions allows to obtain a signal corresponding to vibrations (deflections) of a string in two mutually perpendicular planes, with the influence of the device generating such signals on string vibration parameters being reduced, without signals generated by different strings being mixed and with dimensions of the optical sensor being reduced to allow for its compact placement on a stringed musical instrument.

The invention claimed is:

1. An optical sensor for a stringed musical instrument with a digital interface comprising:

a housing configured to be fixed to the surface of the stringed musical instrument, at least one optical emitter and at least one optical receiver located on said housing so that a light beam of at least one optical emitter forms a light spot that completely covers a photosensitive surface of at least one optical receiver, the at least one optical emitter and at least one optical receiver being located under the same string, wherein said optical emitter generates light beams, said optical receiver comprises at least two photosensitive surfaces, forming, together with said optical emitter, at least two optical pairs, a lower one and an upper one respectively, a light beam modulator located between said optical pairs, covering a part of each of the photosensitive surfaces, and configured to be fixed to a string and configured to adjust an area of an illuminated part of the upper photosensitive surface and an area of an illuminated part of the lower photosensitive surface when a string, with said modulator attached thereto, deflects in horizontal and vertical planes, respectively.

2. An optical sensor according to claim 1 wherein said optical sensor is equipped with a string vibration damper having the form of an elastic element.

3. An optical sensor according to claim 1 wherein the light beams coming from said optical emitter to said optical receiver are parallel to each other and to a string.

4. An optical sensor according to claim 1 wherein said optical emitter is configured as two LEDs.

5. An optical sensor according to claim 1 wherein said optical sensor comprises additional optical emitters.

6. An optical sensor according to claim 1 wherein said optical receiver is configured as a photodiode or as a phototransistor, or as a photoresistor, or as a photomatrix.

7. An optical sensor according to claim 1 wherein said modulator is configured as an opaque element.

8. An optical sensor according to claim 1 wherein said modulator overlaps at least half of each of the photosensitive surfaces in a state when a string does not vibrate.

9. An optical sensor according to claim 1 wherein said light beam modulator is configured to be L- or T-shaped.

10. An optical sensor according to claim 1 wherein a lower part of said light beam modulator is configured to have an additional elastic element to fix the modulator to the surface of a stringed musical instrument.

11. A stringed musical instrument with a digital interface comprising:

a body, at least one string stretched over said body, an optical sensor comprising a housing attached to the surface of said body of the stringed musical instrument, at least one optical emitter and at least one optical receiver located on said housing so that a light beam of at least one optical emitter forms a light spot that completely covers a photosensitive surface of at least one optical receiver, with at least one optical emitter and at least one optical receiver being located under the same string, wherein said optical emitter generates light beams, said optical receiver comprises at least two photosensitive surfaces, forming, together with said optical emitter, at least two optical pairs, a lower one and an upper one respectively, a light beam modulator located between said optical pairs, covering a part of each of the photosensitive surfaces, and configured to be fixed to a string and configured to change an area of an illuminated part of the upper photosensitive surface and an area of an illuminated part of the lower photosensitive surface when a string, with said modulator attached thereto, deflects in horizontal and vertical planes, respectively.

12. The stringed musical instrument with a digital interface according to claim 11 wherein said optical sensor is equipped with a string vibration damper having the form of an elastic element.

13. The stringed musical instrument with a digital interface according to claim 11 wherein light beams coming from said optical emitter to said optical receiver are parallel to each other and to a string.

14. The stringed musical instrument with a digital interface according to claim 11 wherein said optical emitter is configured as two LEDs.

15. The stringed musical instrument with a digital interface according to claim 11 wherein said optical sensor comprises additional optical emitters.

16. The stringed musical instrument with a digital interface according to claim 11 wherein said optical receiver is configured as a photodiode or as a phototransistor, or as a photoresistor, or as a photomatrix.

17. The stringed musical instrument with a digital interface according to claim 11 wherein said modulator is configured as an opaque element.

18. The stringed musical instrument with a digital interface according to claim 11 wherein said modulator overlaps at least half of each of the photosensitive surfaces in a state when a string does not vibrate.

19. The stringed musical instrument with a digital interface according to claim 11 wherein said light beam modulator is configured to be L- or T-shaped.

20. The stringed musical instrument with a digital interface according to claim 11 wherein a lower part of said light beam modulator is configured to have an additional elastic element to fix the modulator to the surface of a stringed musical instrument.

* * * * *